United States Patent [19]

Wallis

[11] Patent Number: 5,038,891

[45] Date of Patent: Aug. 13, 1991

[54] REFRIGERANT COMPRESSOR

[75] Inventor: Frank S. Wallis, Sidney, Ohio

[73] Assignee: Copeland Corporation, Sidney, Ohio

[21] Appl. No.: 509,026

[22] Filed: Apr. 12, 1990

[51] Int. Cl.[5] ..... F01M 1/00

[52] U.S. Cl. ..... 184/6.16; 417/368

[58] Field of Search ..... 184/6.16, 6.17, 6.18; 417/435, 368

[56] References Cited

U.S. PATENT DOCUMENTS

| | | | |
|---|---|---|---|
| 3,162,360 | 12/1964 | Privon et al. | 417/372 |
| 3,253,776 | 5/1966 | Parker | 184/6 |
| 3,311,292 | 3/1967 | Connor | 415/211.2 |
| 3,674,382 | 4/1972 | Kubota et al. | 184/6.18 |
| 3,736,076 | 5/1973 | Ayling | 417/372 |
| 3,804,202 | 4/1974 | Funke | 184/6.16 |
| 4,111,612 | 9/1978 | Paczuski | 184/6.16 |
| 4,470,772 | 9/1984 | Gannaway | 417/368 |
| 4,747,471 | 5/1988 | Ballentine et al. | 184/6.18 |
| 4,834,627 | 5/1989 | Gannaway | 417/415 |

*Primary Examiner*—James C. Yeung
*Assistant Examiner*—Alan B. Curiaso
*Attorney, Agent, or Firm*—Harness, Dickey & Pierce

[57] ABSTRACT

A refrigeration compressor is disclosed which incorporates an improved lubrication system to insure adequate lubrication to all bearings via a single elongated axial offset passage provided in the crankshaft. The lubrication system also incorporates a passage arrangement which serves to vent any refrigerant gases which may be encountered as well as to prevent priming of the vent passage which could result in transfer of lubricant into the motor compartment.

8 Claims, 2 Drawing Sheets

REFRIGERANT COMPRESSOR

BACKGROUND AND SUMMARY OF THE INVENTION

The present invention relates generally to refrigeration compressors and more particularly to lubrication systems for hermetic refrigeration compressors.

Refrigeration compressors and more specifically refrigeration compressors of the hermetically sealed reciprocating piston type normally provide a reservoir of lubricating oil in the lower portion or sump of the sealed shell. Pumping means are normally provided which operate to circulate oil to the bearings through passages provided in the crankshaft. Because the oil is in open communication with the refrigerant, it is not uncommon for some of the refrigerant in liquid and gaseous form to become mixed in the oil. As the oil is heated during operation of the compressor, portions of this liquid refrigerant will be boiled off. It is therefore important that the crankshaft lubrication passages incorporate venting means to avoid vapor lock which could block the flow of lubricant to the bearings. It is also generally desirable to minimize the amount of intermixing of the oil and suction gas flowing to the compressor to both prevent slugging of the compressor as well as the carry over of oil into the refrigeration system.

Accordingly, the present invention provides an improved lubrication system which incorporates passages to effectively vent any gaseous refrigerant therefrom yet still assure that no oil is carried over into the primary suction gas flow area. The system is economical to manufacture yet also assures full and complete lubrication of all bearing surfaces over a wide range of operating conditions while also minimizing the potential for mixing of the oil with the suction gas flowing to the compression cylinders.

Additional advantages and features of the present invention will become apparent from the subsequent description and the appended claims taken in conjunction with the accompanying drawings.

DESCRIPTION OF THE PREFERRED EMBODIMENTS

Figure 1:
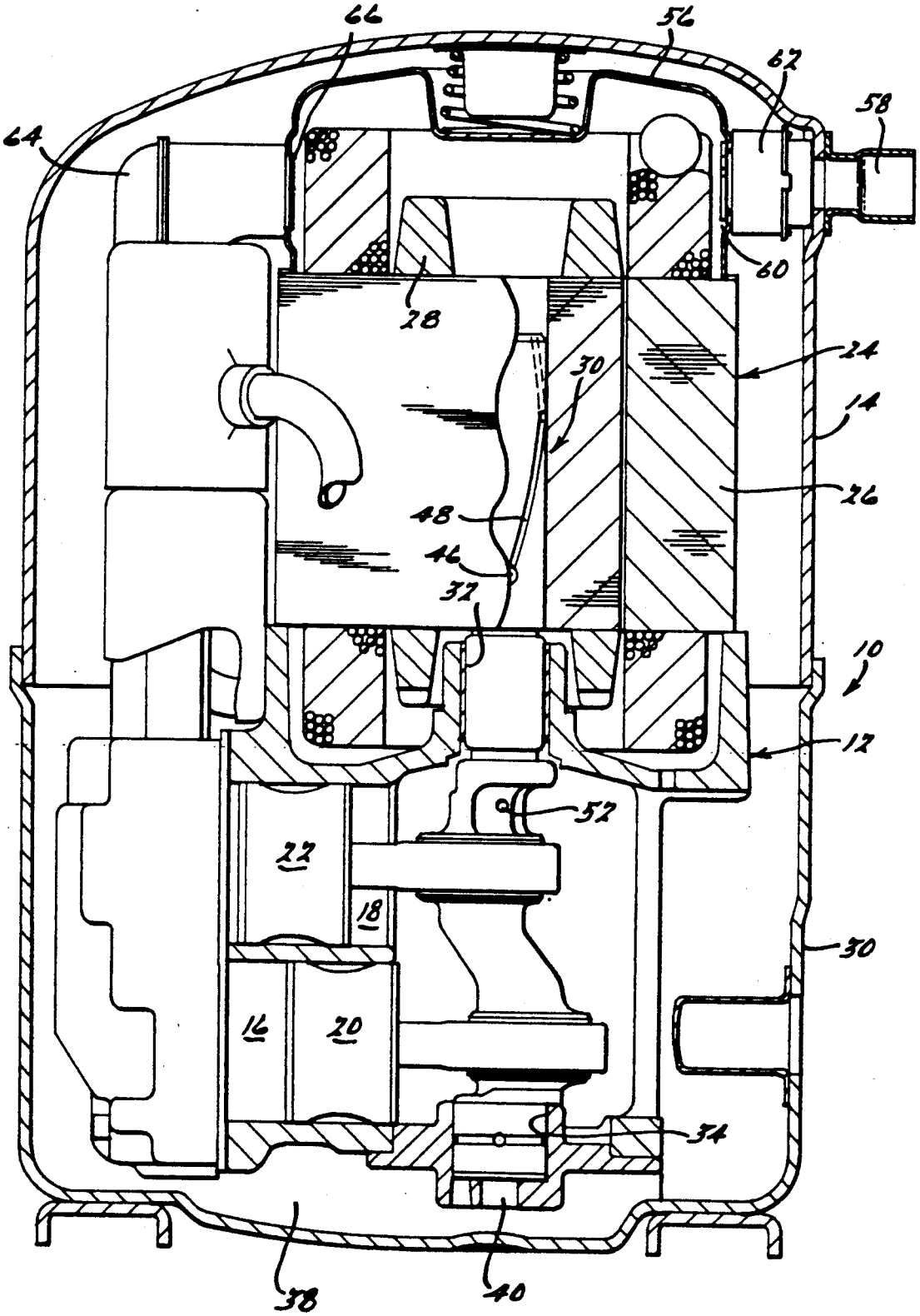
FIG. 1 is a section view of a hermetic refrigeration compressor incorporating a lubrication system in accordance with the present invention.

Referring now to the drawings and more specifically to FIG. 1, there is shown a refrigeration compressor 10 of the hermetic reciprocating piston type. Compressor 10 includes a compressor housing 12 supported within outer shell 14 and including a pair of compression cylinders 16 and 18 within which pistons 20 and 22 are respectively reciprocatingly disposed. An electric motor 24 is operative to reciprocatingly drive pistons 20 and 22 and includes a stator 26 secured to compressor housing 12 and a rotor 28. Rotor 28 is secured to and operative to drive crankshaft 30 which is rotatably journaled in upper and lower bearings 32 and 34.

As shown, the upper end of motor 24 is enclosed by a shroud 56 secured to stator 26. An inlet opening 58 is also provided in outer shell 14 in aligned relationship to a suction inlet opening 60 provided in motor shroud 56. A suction coupling 62 carried by shroud 56 includes a telescopically movable portion which is biased into engagement with the inner surface of shell 14 so as to direct substantially all suction gas entering shell 14 into the thus defined motor chamber. A suction outlet conduit 64 is fitted within another opening 66 provided in shroud 56, opening 66 being positioned in circumferentially spaced relationship to suction inlet opening 60. Suction outlet conduit 64 operates to conduct suction gas across the end turns of motor stator 26 and deliver same to respective cylinders 20, 22 for compression.

Figure 2:
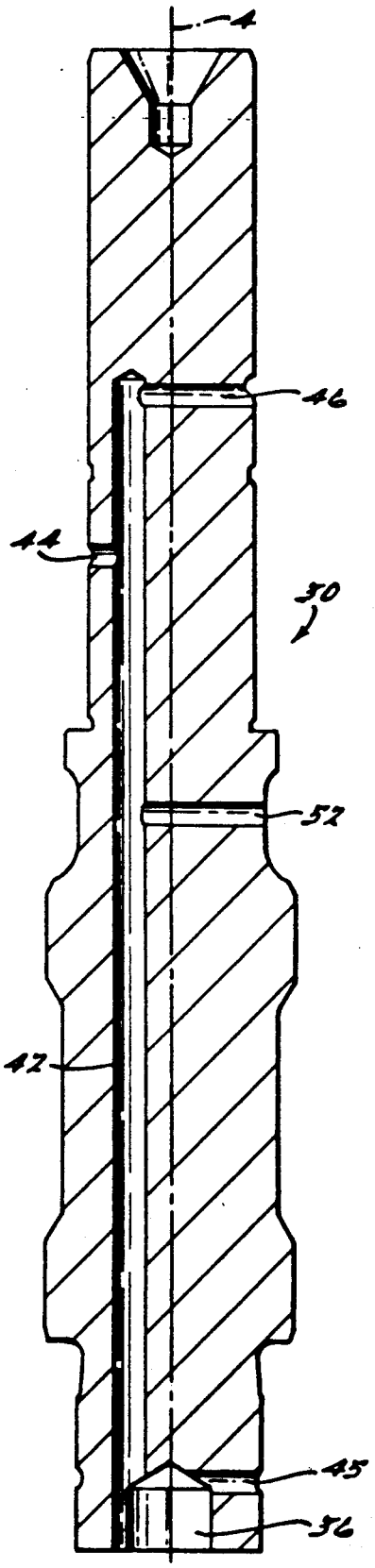
FIG. 2 is a section view of the crankshaft incorporated in the refrigeration compressor of FIG. 1, the section being taken along a radial plane extending along the axis of rotation.
Figure 3:
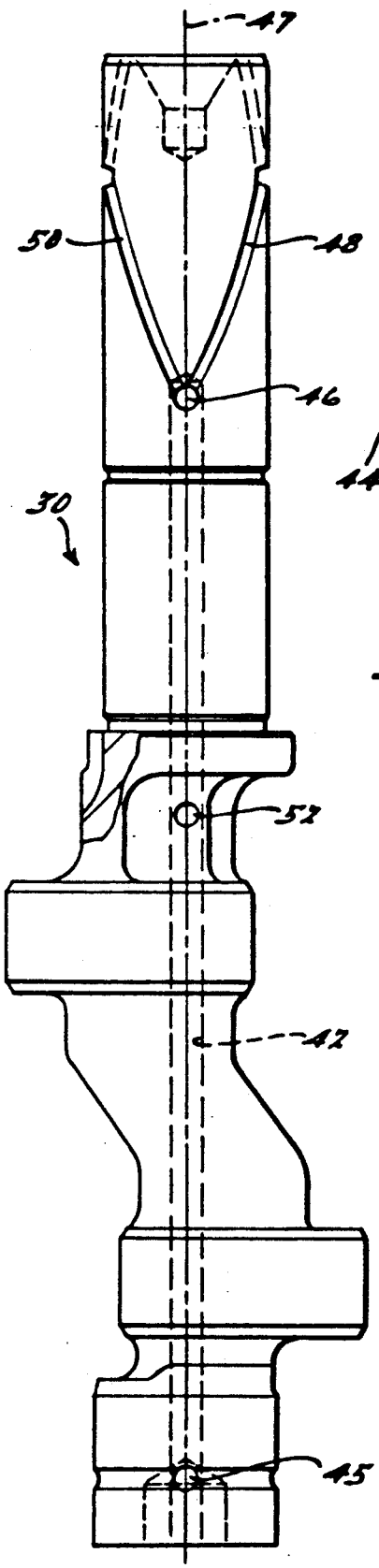
FIG. 3 is a view in elevation of the crankshaft of FIG. 2 rotated approximately 90°.

As best seen with reference to FIGS. 2 and 3, crankshaft 30 incorporates a centrifugal oil pumping means in the form of a relatively large diameter axially inwardly extending bore 36 positioned in coaxial relationship to the axis of rotation thereof and opening outwardly from lower end thereof. Bore 36 is in open communication with the oil sump 38 in the bottom of shell 14 via passage 40 in the lower bearing housing. An elongated axially extending main oil feed passage 42 is positioned in radial offset relationship to the axis of rotation of crankshaft 30 and in intersecting relationship to bore 36. A relatively short bore 44 extends radially outwardly from passage 42 and serves to provide lubricant flow to upper bearing 32 and a second passage 45 extends radially outwardly from bore 36 to provide lubricant flow to lower bearing 34. Additional passages (not shown) are provided to supply lubricant flow to each of the respective piston rod bearings.

In order to avoid the accumulation of trapped vapor within passage 42 which could possibly prevent adequate lubrication flow, a first vent passage 46 is provided extending in a radial direction across the axis of rotation 47 of crankshaft 30 from the upper end of passage 42 and opens outwardly through the outer surface of crankshaft 30 in an area underlying rotor 28. A pair of chevron grooves 48, 50 are provided in the outer surface of crankshaft 30 and extend axially upwardly in oppositely spiralling directions from passage 44 so as to allow any gases within passage 42 to vent above the motor.

Under certain high temperature operating conditions the amount of gas within the refrigerant may increase substantially to the point where it is desirable to provide multiple vents for passage 42 to insure adequate lubricant flow therethrough. Additionally, at low operating temperatures such as at startup, there may be a substantial amount of liquid refrigerant in the oil which will be boiled off as the oil warms thus also increasing the volume of gas within passage 42. Accordingly, a second vent passage 52 is also provided in crankshaft 30 also extending radially across the axis of rotation 47 and opening outwardly therefrom at a location below the upper bearing 32. This vent passage will not only operate as an additional gas vent for refrigerant vapors within passage 42 but also serves as a siphon break vent in the event the upper vent 46 should inadvertently become primed and commence pumping of oil. Such a situation could occur in the event the pressure differential between the oil sump and the area enclosed within the motor cover becomes sufficiently great to draw oil from passage 42 across the axis of rotation of the crankshaft through passage 46. Once passage 46 becomes filled with oil up to the axis of rotation, priming will be complete and from that point on passage 46 will act as a centrifugal pump. However, in the present invention, should passage 46 become primed and begin to pump, the reduction in pressure within passage 42 will result in gas being drawn in through passage 52 and up passage 42 to break the primed condition existing in passage 46. This will occur without significant interruption in flow of lubrication to upper bearing 32 as the greater mass of the lubricating oil versus the refrigerant gas combined with the centrifugal force due to rotation of the crankshaft will cause a radially inner and outer stratification between the two fluids. That is, the gas being lighter will flow along the radially inner surfaces of passage 42 while oil will be thrown to the cuter portion thereof. Thus, the provision of passage 52 serves to limit the potential for oil to be pumped into the suction gas flow path within the motor area and hence reduces the potential mixing and carry over thereof into the refrigeration system. It should be noted that there also exists the possibility of passage 52 being primed in the same manner described above with respect to passage 46. While this can occur, it does not give rise to the same concerns noted above because passage 52 opens into the crankcase which in turn is in open communication with the oil sump. Hence, any oil pumped out through passage 52 will be returned to the sump and does not pose the same potential problem with respect to intermixing with the suction gas.

Figure 4:
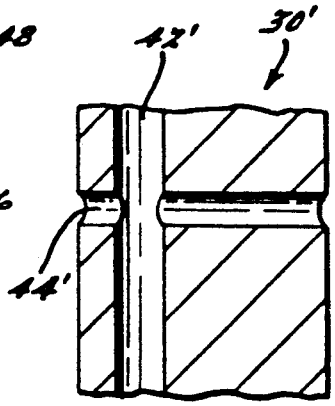
FIG. 4 is an enlarged fragmentary view of a portion of the crankshaft of FIG. 2 showing an alternative arrangement therefor.

Referring now to FIG. 4, a portion of crankshaft 30' is shown wherein corresponding portions thereof are indicated by like numbers primed and which incorporates an alternative arrangement for forming the passage 44 of crankshaft 30. In this embodiment, passage 44' is formed by drilling diametrically through crankshaft 30' from the same side of the crankshaft that passages 46, 52 and 45 open outwardly. There is no need to plug the longer portion of passage 44'. This procedure enables all of the radially extending passages to be formed from one side of the crankshaft thereby eliminating the need to reposition the crankshaft for two separate drilling operations.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. In a refrigeration compressor including an outer shell, a compressor means disposed within the shell, a drive shaft for driving said compressor means, bearing means for rotatably supporting said drive shaft, motor means operatively connected to said drive shaft and a lubricant sump in said shell, said drive shaft having one end extending into said sump, an improved lubrication system comprising:

pumping means associated with said one end of said drive shaft;

axially extending passage means within said drive shaft for distributing lubricant from said pumping means to said bearing means;

a first vent passage communicating with said axially extending passage adjacent an upper end thereof; and a second vent passage communicating with said axially extending passage at a location between said first vent passage and said pumping means, said second vent passage being operative to interrupt the pumping action generated by said first vent passage in the event of priming of said first vent passage.

2. A refrigeration compressor as set forth in claim 1 wherein said compressor has a shroud enclosing one end of said motor through which suction gas flows, said first vent passage vents into the area enclosed by said shroud.

3. A refrigeration compressor as set forth in claim 2 wherein said second vent passage vents into an area remote from said enclosed area.

4. A refrigeration compressor as set forth in claim 1 wherein said first and second vent passages extend across the axis of rotation of said crankshaft.

5. In a refrigeration compressor including an outer shell, compressor means supported within said shell, a drive shaft coupled to said compressor means, motor means including a stator having one end secured to said compressor means and a rotor secured to said drive shaft and cooperating with said stator to drive said compressor means, upper and lower bearings for rotatably supporting said drive shaft, a shroud secured to the other end of said stator and defining a substantially enclosed area from which suction gas is drawn into said compressor means, a lubricant sump in the lower portion of said shell, an improved lubrication system for supplying lubricant from said sump to said upper and lower bearing means comprising:

pumping means in one end of said drive shaft, said one end being disposed within said sump;

elongated axially extending passage means within said drive shaft positioned in radially offset relationship to the axis of rotation of said drive shaft;

first and second radial passage means for supplying lubricant from said pumping means to said upper and lower bearings;

first vent passage means communicating with said axially extending passage adjacent the upper end thereof, said first vent passage extending generally laterally through said drive shaft so as to vent gases from said axially extending passage into said substantially enclosed area and resist the flow of liquid therethrough; and second vent passage means communicating with said axially extending passage below said first vent passage means, said second vent passage means extending generally laterally through said drive shaft so as to vent gases from said axially extending passage into an open area below said upper bearing and above said sump and to resist the flow of liquid therethrough, said second vent passage also being operative to conduct gas from said open area into axially extending passage to interrupt the flow of liquid through said first vent passage in the event said first vent passage becomes filled with liquid.

6. A refrigeration compressor as set forth in claim 5 wherein said shroud has a suction gas inlet opening therein and said shell has a suction gas inlet positioned in aligned relationship with said shroud opening and coupling means extending between said shroud and said shell to direct substantially all of said suction gas entering said shell into said enclosed area.

7. A refrigeration compressor as set forth in claim 6 wherein said compressor is a reciprocating piston type compressor and said second vent passage opens into a crankcase portion of said compressor means.

8. A refrigeration compressor as set forth in claim 5 wherein said first and second vent passages extend across the axis of rotation of said drive shaft.

* * * * *